US011193196B2

(12) United States Patent
Dubois

(10) Patent No.: US 11,193,196 B2
(45) Date of Patent: Dec. 7, 2021

(54) METHOD AND DEVICE FOR REACTION CONTROL

(71) Applicant: Cockerill Maintenance & Ingenierie S. A., Seraing (BE)

(72) Inventor: Michel Dubois, Boncelles (BE)

(73) Assignee: COCKERILL MAINTENANCE & INGÉNIERIE S.A., Seraing (BE)

( * ) Notice: Subject to any disclaimer, the term of this patent is extended or adjusted under 35 U.S.C. 154(b) by 590 days.

(21) Appl. No.: 15/571,504

(22) PCT Filed: Apr. 25, 2016

(86) PCT No.: PCT/EP2016/059123
§ 371 (c)(1),
(2) Date: Nov. 3, 2017

(87) PCT Pub. No.: WO2016/177590
PCT Pub. Date: Nov. 10, 2016

(65) Prior Publication Data

US 2018/0142339 A1 May 24, 2018

(30) Foreign Application Priority Data

May 7, 2015 (EP) ..... 15166714
Nov. 25, 2015 (EP) ..... 15196189

(51) Int. Cl.
*C21D 9/56* (2006.01)
*C23C 8/14* (2006.01)
(Continued)

(52) U.S. Cl.
CPC ..... *C23C 8/14* (2013.01); *C21D 1/26* (2013.01); *C21D 9/46* (2013.01); *C21D 9/56* (2013.01);
(Continued)

(58) Field of Classification Search
CPC .... C23C 2/02; C23C 2/06; C23C 2/40; C21D 9/56
See application file for complete search history.

(56) References Cited

U.S. PATENT DOCUMENTS

2010/0173072 A1 7/2010 Borrel
2010/0269367 A1 10/2010 Langevin et al.
(Continued)

FOREIGN PATENT DOCUMENTS

CN 201908124 U 7/2011
CN 103849825 * 6/2014 ..... C23C 2/02
(Continued)

*Primary Examiner* — Lois L Zheng
(74) *Attorney, Agent, or Firm* — Leydig, Voit & Mayer, Ltd.

(57) ABSTRACT

A furnace for annealing a sheet includes: a first section; a second vertical section, the second vertical section including openings supplied with an oxidizing medium, an opening facing each side of the sheet, and means for separately controlling a flow of the oxidizing medium on each side of the sheet; and a third section. The second vertical section is located in a distinct casing and separated from the first and third sections with sealing devices. The second vertical section includes extraction openings for extracting the oxidizing medium not consumed by the sheet, an extraction opening facing each side of the sheet. The openings supplied with an oxidizing medium are located transversally at one end of the second vertical section. The extraction openings are located transversally at an other end of the second vertical section.

13 Claims, 4 Drawing Sheets

(51) Int. Cl.

| | |
|---|---|
| ***F27B 9/14*** | (2006.01) |
| ***F27D 7/06*** | (2006.01) |
| ***F27B 9/04*** | (2006.01) |
| ***C21D 1/26*** | (2006.01) |
| ***C21D 9/46*** | (2006.01) |
| ***C21D 11/00*** | (2006.01) |
| ***F27D 7/04*** | (2006.01) |
| *C23C 2/06* | (2006.01) |

(52) U.S. Cl.

CPC ..... *C21D 9/561* (2013.01); *C21D 11/00* (2013.01); *F27B 9/04* (2013.01); *F27B 9/045* (2013.01); *F27B 9/14* (2013.01); *F27B 9/145* (2013.01); *F27D 7/04* (2013.01); *F27D 7/06* (2013.01); *F27D 2007/045* (2013.01); *F27D 2007/063* (2013.01)

(56) References Cited

U.S. PATENT DOCUMENTS

| | | | | |
|---|---|---|---|---|
| 2011/0018178 | A1 | 1/2011 | Muller et al. | |
| 2014/0203482 | A1 | 7/2014 | Blumenau et al. | |
| 2016/0265079 | A1 * | 9/2016 | Takahashi ..... | C21D 9/56 |

FOREIGN PATENT DOCUMENTS

| | | | |
|---|---|---|---|
| EP | 2458022 | A1 | 5/2012 |
| EP | 2857532 | A1 | 4/2015 |

* cited by examiner

METHOD AND DEVICE FOR REACTION CONTROL

CROSS-REFERENCE TO PRIOR APPLICATIONS

This application is a U.S. National Phase application under 35 U.S.C. § 371 of International Application No. PCT/EP2016/059123, filed on Apr. 25, 2016, and claims benefit to European Patent Application No. 15166714.4, filed on May 7, 2015, and European Patent Application No. 15196189.3, filed on Nov. 25, 2015. The International Application was published in English on Nov. 10, 2016 as WO 2016/177590 under PCT Article 21(2).

FIELD

The invention relates to a device and a method for controlling the surface reaction on steel sheets transported in a continuous galvanizing or annealing line.

BACKGROUND

High strength steel grades generally comprise high contents of elements like silicon, manganese and chromium (respectively typically between 0.5 and 2%, 1.5 and 6%, 0.3 and 1% in wt) making them difficult to coat because an oxide layer of those elements is formed during the annealing preceding the dipping in the galvanizing bath. This oxide layer harms the wetting ability of the steel surface when submerged in the bath. As a result, uncoated areas and a poor adhesion of the coating are obtained.

A well-known method to improve the wetting of these steel grades consists in fully oxidizing the steel surface in a specific chamber when the steel has a temperature typically between 600 and 750° C. The resulting oxide layer comprises a high amount of iron oxides which are then reduced during the end of heating and holding section of the annealing furnace and the following thermal treatment. The target is to obtain an oxide thickness between around 50 and 300 nm, what corresponds to an iron oxide below 2 gr/m$^2$.

There are different ways to oxidize the steel surface before the reduction step. For example, this oxidation can be performed in a direct fired furnace running the combustion with air excess. Another way consists in making this oxidation in a dedicated chamber located in the middle of the annealing furnace and supplied with a mixture of nitrogen and an oxidant. Such implementation is described in the patent EP 2 010 690 B1 and in FIG. 1. The oxidation section is separated from the other parts of the annealing furnace by seals to minimize the introduction of the oxidant in the first and final sections.

The formation of the oxide layer must be carefully controlled to avoid the formation of too thick layers, too thin layers or non-uniform layers, all resulting in quality problems on the finished product. Four main parameters influence the layer formation: the strip temperature, the oxygen concentration in the atmosphere of the chamber, the transport of that oxygen to the steel surface and the residence time.

A change in these parameters has a direct impact on the oxide formation and must be compensated. For example, a change in the line speed, what is usual in a production line, results in a change of the residence time. Changing the oxygen concentration in the chamber is the easiest way to compensate this variation. However, if the adjustment of the oxygen content in a fully fresh inert gas is quite easy by controlling the relative volume, it is much more complicated when the oxidizing medium not fully consumed is recirculated.

Dimensional parameters such as the frequent change in the strip width or a non-symmetric positioning of the strip in the chamber can also influence the oxide formation.

A different oxide layer formation between both sides of the strip can also be observed because, due to internal buoyancy flow or due to strip entrainment, the mass transport of the oxidant to the steel surface can be different.

Documents US 2010/0173072, CN 201 908 124 and EP 2458022 disclose devices wherein injection means on both sides of the strip that can be separately controlled in the oxidation section. However, these devices do not allow a fine control of the oxidation process because the oxidation section is not sealed from the atmosphere of the other sections. In practice, it means that the oxidant medium of the oxidation section circulates in the other sections, what makes impossible a fine control in the oxidation section and contaminates the atmosphere of the other sections.

SUMMARY

In an embodiment, the present invention provides a furnace for annealing a sheet, the furnace comprising: a first section; a second vertical section, the second vertical section comprising openings supplied with an oxidizing medium, an opening facing each side of the sheet, and means configured to separately control a flow of the oxidizing medium on each side of the sheet; and a third section, wherein the second vertical section is located in a distinct casing and separated from the first and third sections with sealing devices, wherein the second vertical section comprises extraction openings configured to extract the oxidizing medium not consumed by the sheet, an extraction opening facing each side of the sheet, wherein the openings supplied with an oxidizing medium are located transversally at one end of the second vertical section, and wherein the extraction openings are located transversally at an other end of the second vertical section.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
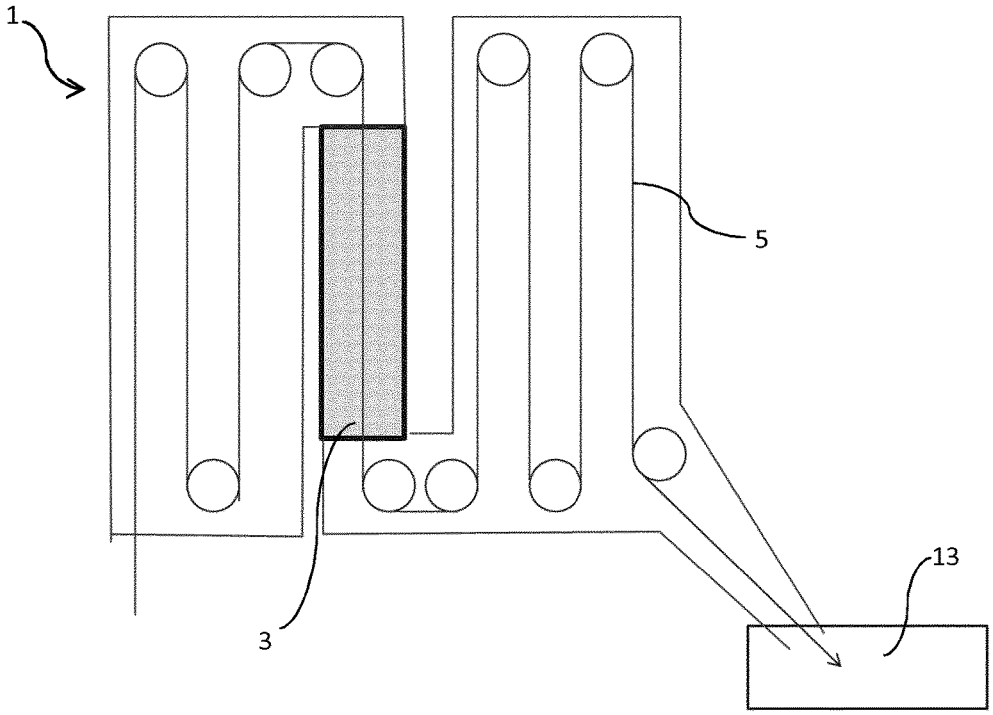
FIG. 1 schematically represents an annealing furnace comprising a n oxidation section according to the state of the art.

The present invention relates to a furnace for annealing a sheet comprising a first section, a second vertical section and a third section, said second section comprising openings supplied with an oxidizing medium, an opening facing each side of the sheet, wherein the second section comprises means for separately controlling the flow of the oxidizing medium on each side of the sheet, the second section being located in a distinct casing and separated from the first and third sections with sealing devices and the second section comprising extraction openings for extracted the oxidizing medium not consumed by the sheet.

According to particular preferred embodiments, the furnace according to the invention further comprises at least one or a suitable combination of the following features:

the second section comprises two independent injection pipes respectively supplying each side of the sheet and wherein the means comprise a fan on each injection pipe;

the second section comprises two injection pipes respectively supplying each side of the sheet, one injection pipe being mounted on the other injection pipe to be interconnected, wherein the means comprise a single fan mounted on one of the injection pipes and comprise a valve also mounted on one of the injection pipes;

the means comprise a single valve mounted on an injection pipe downstream of the connection between the injection pipes;

the means comprise a valve mounted on each injection pipe downstream of the connection between the injection pipes;

the second section further comprises means for separately controlling for each side the temperature of the oxidizing medium and the oxidant concentration in the oxidizing medium;

the openings supplied with an oxidizing medium are located at the top of the second section;

the opening supplied with an oxidizing medium are slots extending transversally at the top of the second section.

The present invention also relates to a method for controlling a surface reaction on a sheet running through the second section of the furnace as described above, comprising a step of separately controlling the flow of the oxidizing medium on each side of the sheet and a step of extraction of the oxidizing medium after the oxidation of the sheet.

According to particular preferred embodiments, the method according to the invention further comprises at least one or a suitable combination of the following features:

—the flow is adjusted by changing the rotation speed of the fan;

it further comprises a step of separately controlling the temperature of the oxidizing medium and the oxidant concentration in the oxidizing medium on each side of the sheet;

after the oxidation of the sheet, the oxidizing medium is extracted from the second section and recirculated in the second section;

the oxidant concentration to be injected is based on the measurements of the oxidant concentration in the oxidizing medium extracted from the second section;

the temperature of the oxidizing medium is between 50 and 200° C. below the sheet temperature.

The invention aims to provide a method with process parameters adjusted to control separately the oxide formation on each side of the steel sheet. This method allows easily adjusting the concentration and flow of the oxidant medium according to the strip width, the line speed and the steel grade. For this purpose, an annealing furnace comprising specific control means in the oxidation chamber has been developed. To allow a fine control of the oxidation, the oxidation chamber is located in a distinct casing comprising sealing means at each end and is provided with extraction means in order to control the flow of oxygen not fully consumed by the oxidation process of the sheet.

Figure 2:
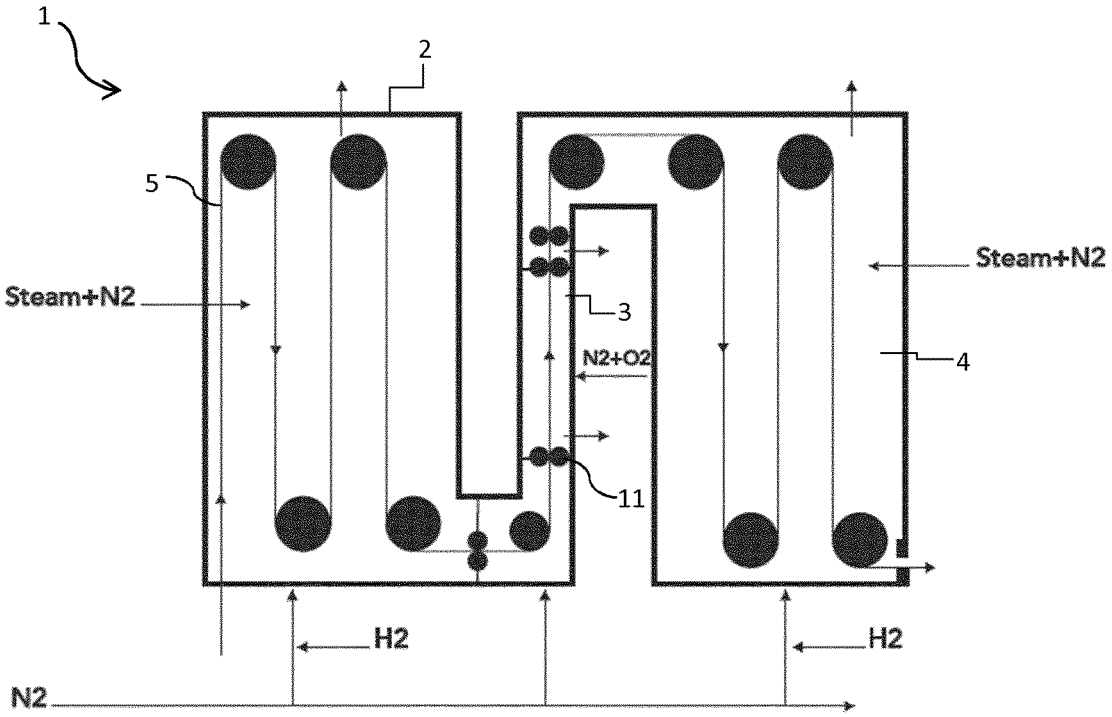
FIG. 2 schematically represents an annealing furnace comprising three separated sections according to the invention. The incoming and outgoing flows through the different sections are also schematically represented.

The furnace 1 represented in FIG. 2 is dedicated to anneal steel sheets to be coated by a liquid metal comprising Zn, Al or a combination of those two in various proportions with an eventual addition of Mg and Si in proportion higher than 0.1%. The furnace according to the invention can also be used in a continuous annealing line without hot-dip galvanizing facilities.

The furnace has different sections, each located in a distinct casing.

The first section 2 of the furnace 1 is a classical heating section comprising heating elements and rolls. It can be a resistance heating, an inductive heating or a radiant tube heater. This section is slightly oxidizing to limit the risk of external oxidation of the alloying elements and potentially to start forming a Fe oxide in some cases. To this end, the $H_2$ content is below 2%, the $0_2$ level is below 0.1%, the $H_2O$ or $C0_2$ content or the sum $H_2O$ and $C0_2$ ($H_2O$+$C0_2$) is superior to 0.03% and, preferably superior to 0.035%, but inferior to 10% to obtain this atmosphere slightly oxidizing.

The second section 3 is the oxidation chamber wherein an oxidizing mixture composed of an oxidant such as $0_2$ and an inert gas like $N_2$ is injected to form a controlled iron oxide layer on the surface of the steel sheet. This section will be further detailed below.

The third section 4 has a reducing atmosphere to reduce the iron oxide formed in the second section. The classical practice is to use $H_2$ mixed with an inert gas, the concentration of $H_2$ being adjusted between 3 and 30% and preferably between 5 and 20%.

Figure 3:
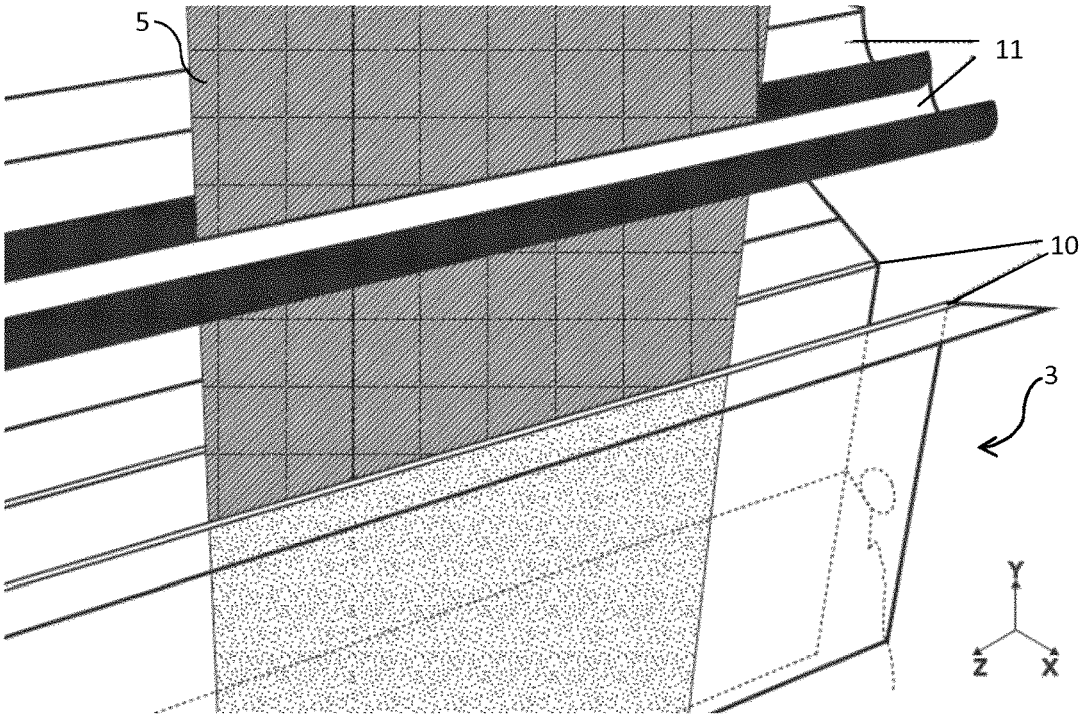
FIG. 3 represents the upper part of the oxidation chamber according to the invention with the transversal openings for injecting the oxidizing medium.
Figure 4:
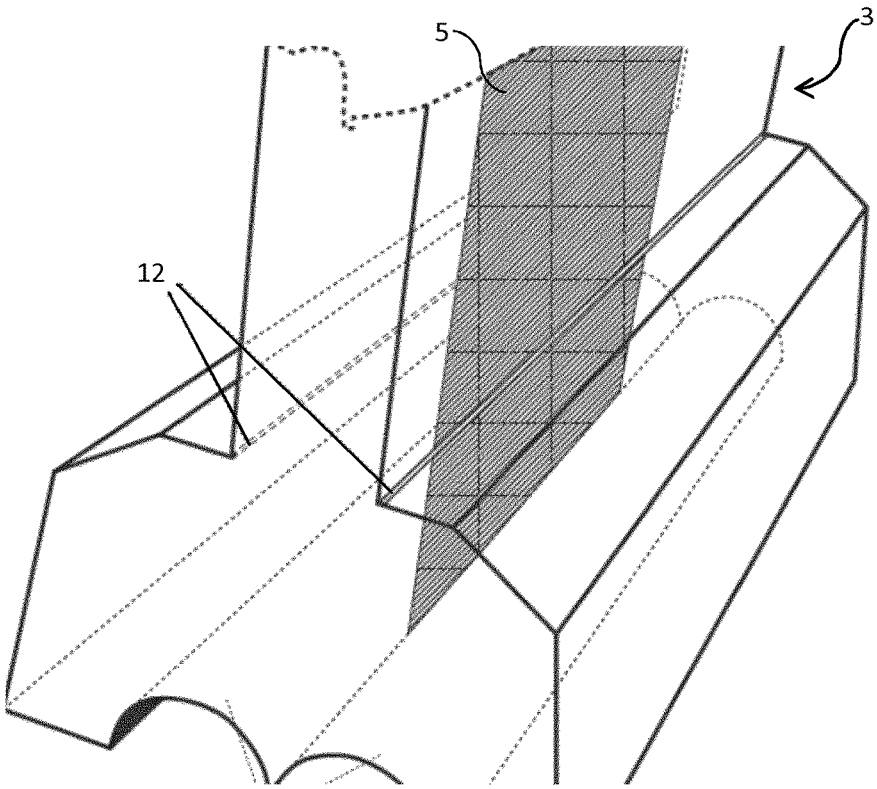
FIG. 4 represents the lower part of the oxidation chamber with the extraction openings according to the invention.

The second section 3 is a vertical section with sealing devices 11 like rolls or gates at the entry and exit of the section to separate this section from the first and third sections and so to minimize the flow of the oxidant in the other sections of the furnace. The oxidizing medium is injected on the sheet surface by openings, preferably forming slots, which ensure a uniform distribution of the flow all across the chamber. The openings 10 are located on each side of the sheet 5 and preferably located transversally at one end of the oxidation chamber 3 as shown in FIG. 3. More preferably and for reasons explained hereafter, they are located at the top of the oxidation chamber. On the opposite side of the openings 10, i.e. at the bottom of the oxidation chamber if the oxidant injection is carried out at the top, the chamber comprises extraction openings 12 to extract the oxidant not consumed by the sheet and to reduce the pressure inside the second section.

According to the invention, the second section 3 is provided with means for controlling separately the flow of the oxidizing medium on each side of the steel sheet. Preferably, it also comprises means for controlling separately the oxidant concentration and the temperature of the oxidizing medium for each side of the steel sheet.

Figure 5:
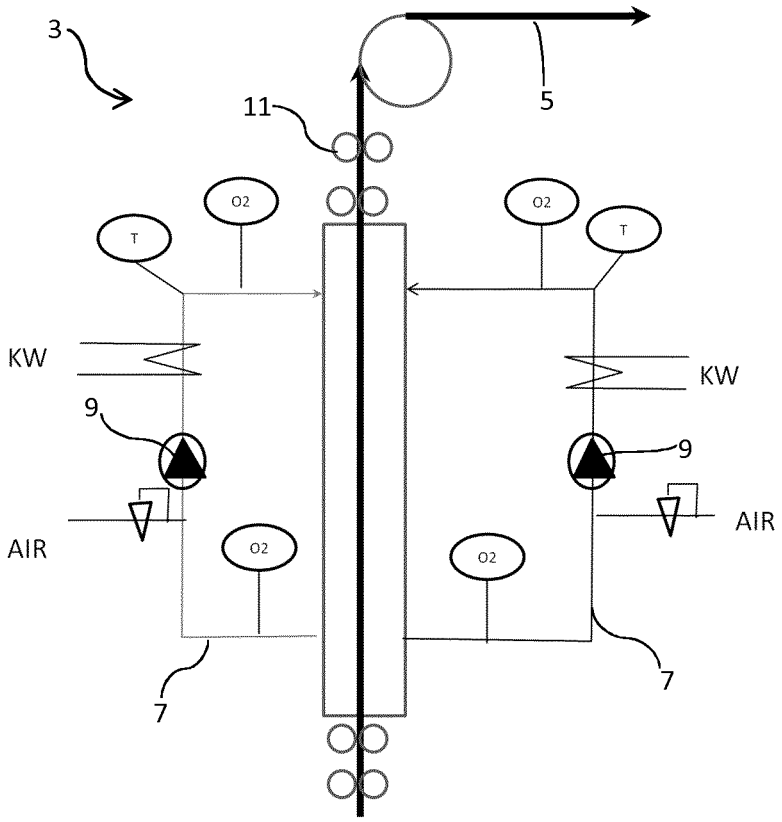
FIG. 5 represents according to a first embodiment of the invention the control means for regulating the parameters of the atmosphere in the second section i.e. in the oxidation section.

The control system according to a first embodiment of the invention is described in FIG. 5. In this embodiment, the flow, the oxidant concentration and its temperature are separately controlled for each side. The injecting pipes 7 of the two sides are independent and the flow on each side is controlled by a fan 9 whose speed is adjusted depending on the desired flow. To avoid an overpressure in the oxidation chamber and to allow a fine control of the oxidation process on both sides of the sheet, the injected flow is extracted. For economic reasons, the gas extracted from the chamber is preferably recirculated. Since the injected oxidant is partly consumed by the sheet with a percentage consumed depending on the steel grade, the sheet temperature and the surface flow (in $m^2$/sec), a fresh oxidant is injected with a concentration based on the measurement of the residual oxidant in the extracted flow and the flow is fixed by the fan rotation speed. In case the oxygen concentration is adjusted with air, the amount of added air is calculated on the basis of a mass balance as follows:

[Added Air Flow*0.21+(Injected flow−Added air)*% $0_2$ in the extracted flow]/(Injected flow)=Target $0_2$ in injection, wherein the injected flow corresponds to the extracted flow+added air flow, the flows being expressed in $Nm^3$/h and typically comprises between 50 and 200 Nm3/h per side;

wherein the target in $0_2$ is preferentially comprised between 0.5 et 5% in volume.

Figure 6:
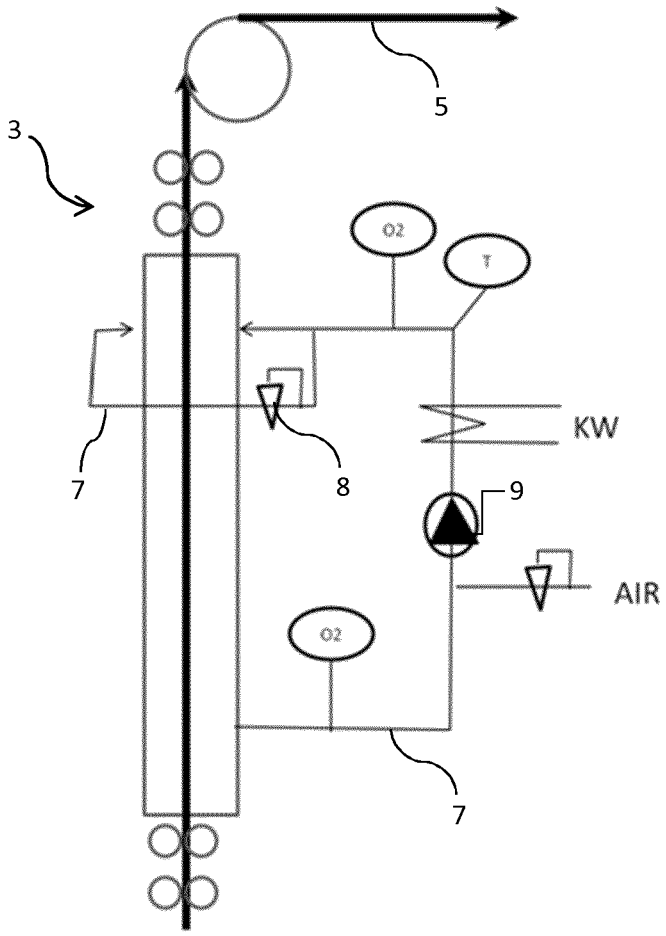
FIG. 6 represents according to a second embodiment of the invention the control means for regulating the parameters of the atmosphere in the second section.

According to a second embodiment represented in FIG. 6, the control system is simplified with only a single fan 9 and heater for both sides. In this configuration, the injection pipe 7 of one side is mounted on the injection pipe 7 of the other side. The flow for each side is controlled by means of a valve 8 installed on the injection pipe 7 of each side or by means of a single valve 8 installed on one of the injection pipes 7 as shown in FIG. 6. The flow may be measured by dedicated devices. The latter configuration with a single valve is preferred. Indeed, the total flow being known by the rotation speed of the fan, the valve can be used to balance each side separately.

The second section can also be provided with additional means to control specifically the oxidation on the edges of the sheet as disclosed in the application EP 151 831 69.

The temperature of the oxidizing mixture, e.g. $N_2$+$0_2$, is between 50° C. and 200° C. below the sheet temperature to take benefit of the buoyancy principle whereby the gas colder than the strip moves down. For this reason, the transversal openings are located at the top of the chamber and, preferably, the strip moves down. Conversely, the gas could be warmer than the strip and the openings located at the bottom of the chamber. To compensate for the eventual variations between sides, the temperature for each side is controlled separately as shown in FIG. 5. The chamber can also be provided with heating elements to compensate for the heat losses.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE SYMBOLS (1) Annealing furnace
(2) First section
(3) Second section, also called oxidation chamber
(4) Third section
(5) Strip or sheet
(6) Sealing roll
(7) Injection pipe
(8) Valve
(9) Fan
(10) Opening for supplying the reactant
(11) Sealing roll (12) Extraction opening
(13) Zinc bath

The invention claimed is:

1. A furnace for annealing a sheet, the furnace comprising:

a first section;

a second vertical section, the second vertical section comprising openings supplied with an oxidizing medium, an opening facing each side of the sheet, and a flow controller configured to separately control a flow of the oxidizing medium on each side of the sheet; and a third section, wherein the second vertical section is located in a distinct casing and separated from the first and third sections with sealing devices, wherein the second vertical section comprises extraction openings configured to extract the oxidizing medium not consumed by the sheet, an extraction opening facing each side of the sheet, wherein the openings supplied with the oxidizing medium are located at one end of the second vertical section and comprise slots extending transversally and horizontally across the second vertical section, and wherein the extraction openings are located transversally at an other end of the second vertical section.

2. The furnace according to claim 1, wherein the second vertical section comprises two independent injection pipes respectively configured to supply each side of the sheet, and wherein the flow controller comprises a fan on each injection pipe.

3. The furnace according to claim 1, wherein the second vertical section comprises two injection pipes respectively configured to supply each side of the sheet, one injection pipe being mounted on the other injection pipe to be interconnected, wherein the flow controller comprises a single fan mounted on one of the injection pipes and comprise a valve also mounted on one of the injection pipes.

4. The furnace according to claim 3, wherein the flow controller comprises a single valve mounted on an injection pipe downstream of the connection between the injection pipes.

5. The furnace according to claim 3, wherein the flow controller comprises a valve mounted on each injection pipe downstream of the connection between the injection pipes.

6. The furnace according to claim 1, wherein the second vertical section further comprises the flow controller configured to separately control for each side a temperature of the oxidizing medium and an oxidant concentration in the oxidizing medium.

7. The furnace according to claim 1, wherein the openings supplied with the oxidizing medium are located at the top of the second vertical section.

8. A method for controlling a surface reaction on the sheet running through the second vertical section of the furnace according to claim 1, comprising:

separately controlling the flow of the oxidizing medium on each side of the sheet; and extracting the oxidizing medium on each side of the sheet after oxidation of the sheet, wherein there is minimal oxidizing medium flow between the first section, the second vertical section, and the third section.

9. The method according to claim 8, wherein the flow is adjusted by changing a rotation speed of the fan.

10. The method according to claim 8, further comprising separately controlling a temperature of the oxidizing medium and an oxidant concentration in the oxidizing medium on each side of the sheet.

11. The method according to claim 8, wherein the oxidizing medium extracted from the second vertical section is recirculated in the second vertical section.

12. The method according to claim 11, wherein the oxidant concentration to be injected is based on measurements of the oxidant concentration in the oxidizing medium extracted from the second vertical section.

13. The method according to claim 8, wherein a temperature of the oxidizing medium is between 50 and 200° C. below a sheet temperature.

* * * * *